United States Patent [19]

Nauman

[11] Patent Number: 4,496,432

[45] Date of Patent: Jan. 29, 1985

[54] ELECTROLYTIC METHODS FOR ENHANCING CONTRAST BETWEEN METALLIC SURFACES

[75] Inventor: Delbert A. Nauman, Indianapolis, Ind.

[73] Assignee: AT&T Technologies, Inc., New York, N.Y.

[21] Appl. No.: 508,382

[22] Filed: Jun. 27, 1983

[51] Int. Cl.[3] ..... G01N 27/46

[52] U.S. Cl. ..... 204/1 T; 204/400

[58] Field of Search ..... 204/1 T, 400

[56] References Cited

U.S. PATENT DOCUMENTS

| | | | |
|---|---|---|---|
| 3,282,805 | 11/1966 | Brown | 204/1 T |
| 3,366,554 | 1/1968 | Linblad | 204/1 T |
| 3,494,837 | 2/1970 | Messner et al. | 204/1 T |
| 3,527,684 | 9/1970 | York et al. | 204/300 R |
| 3,530,045 | 9/1970 | Alburger | 204/1 T |
| 3,551,801 | 12/1970 | Wood et al. | 204/1 T |
| 3,650,909 | 3/1972 | Hopes et al. | 204/18.1 |
| 3,957,511 | 5/1976 | Auramenko et al. | 204/18.1 |
| 4,063,644 | 12/1977 | Hoffman et al. | 204/1 T |
| 4,188,267 | 2/1980 | Seger et al. | 204/1 T |

FOREIGN PATENT DOCUMENTS 2099156 1/1982 United Kingdom ..... 204/1 T

OTHER PUBLICATIONS

Chang "Junction Delineation by Anodic Oxidation in InSb (As, P)", *Solid State Electronics*, vol. 10, pp. 539–544 (1966).

*Primary Examiner*—T. Tung
*Attorney, Agent, or Firm*—R. F. Kip, Jr.

[57] ABSTRACT

A method of producing a high color contrast between nickel and/or copper or their various alloys and a noble metal or noble metal alloy such as in electrical contacts having a nickel or copper base with an overlay of a noble metal or a noble metal alloy bonded to the surface of the base. By making the contact one electrode in an aqueous solution of a readily soluable ionizable solute and impressing a low AC voltage across the solution, a reaction occurs which makes the base of the electrical contact easily visually distinguishable from the metal overlay.

6 Claims, 4 Drawing Figures

ELECTROLYTIC METHODS FOR ENHANCING CONTRAST BETWEEN METALLIC SURFACES

FIELD OF THE INVENTION

This invention relates to the electrolytic art and, more particularly, to electrolytic methods for enhancing the visible contrast between a metallic substrate and an overlay over part thereof of a different metallic substance.

BACKGROUND OF THE INVENTION

The methods hereof were developed to fill a need for inspecting electrical contact material in the form of a wire-like strip comprising a substrate or base of nickel, copper, or nickel or copper alloys, and an overlay on one side of such base of a noble metal or a noble metal alloy. The shape of this contact material is designed so the strip can be welded to a spring base oriented such that the noble metal material will make contact to another such contact on another spring. The noble metal material must, therefore, be precisely located on the wire-like strip of contact material. Due to the extremely high gloss of the metal surfaces and the very small size of the wire-like strip, the location of the noble metal on the base often cannot be seen even aided by a microscope. A method was needed whereby one or both of the base and the overlay could be altered so one could be identified from the other and the precise location of the noble metal material on its base be quickly and easily determined.

SUMMARY OF THE INVENTION

An object of this invention is to provide methods whereby an electric contact material strip comprising a substrate or base of nickel or copper or their alloys and an overlay on one side of such base of noble metallic material can quickly and easily be examined to determine the precise position of the noble metallic material in relation to the overall shape of the strip.

A further object of this invention is that the methods be capable of being performed safely by people untrained in handling corrosive and/or dangerous chemicals and unknowledgeable of the special chemical and metallurgical effects that chemicals have on various metals and alloys.

These and other objects are realized according to the invention by the inducing of a reaction, on the base portion of an electric contact material immersed in an electrolyte solution, by the application of a low AC voltage. The exposed nickel containing or copper containing base darkens perceptibly in certain electrolyte solutions with some bases going to a jet black while the surface of the noble metallic overlay remains unchanged. This produces a highly visible contrast so that the precise location of the noble metallic overlay on the base is easily seen.

BRIEF DESCRIPTION OF DRAWINGS

For a better understanding of the invention, reference is made to the following description of exemplary articles, apparatus and methods involving the invention, and to the accompanying drawings wherein.

DETAILED DESCRIPTION OF ARTICLE AND APPARATUS

Figure 1:
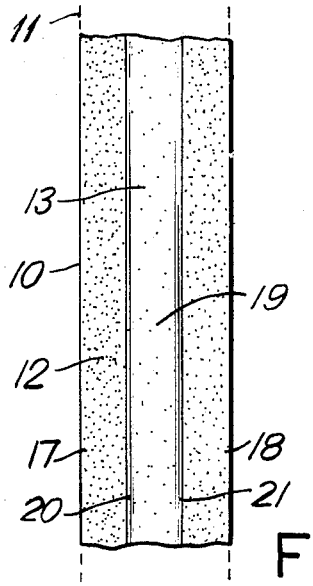
FIG. 1 is a plan view of a broken-away segment of electrical contact material to be treated according to the invention.

Referring now to FIG. 1, the reference numeral 10 designates a segment of electric contact material 11 of much greater length than the segment and from which the segment has been broken away. Contact material 11 comes in rolls (not shown) and is of a form which can be variously described as a wire or strip, but which is commonly referred to in the art as a "tape." The contact material 11 comprises a substrate or base 12 and an overlay 13 centrally disposed on, and covering part of the base 12. Elements 12 and 13 as seen from the top are of strip form.

Figure 2:
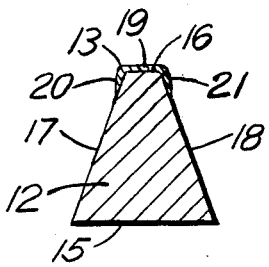
FIG. 2 is a front elevation in cross-section of the FIG. 1 segment.

As shown in FIG. 2, the base 12 of the contact material 11 is, in cross-section normal to its length dimension, in the form of an isosceles trapezoid having a bottom 15, a top 16 parallel to the bottom and two sloping sides 17 and 18 of equal length joining the top and bottom. Overlay 13 has a central portion 19 wholly covering the base top 16. On opposite sides of central portion 19, overlay 13 has two border portions 20 and 21 extending partly down and overhanging the sides 17 and 18, respectively, of the base 12. The overlay 13 is bonded to the base 12 either mechanically (by application to a strip of the overlay of heat and pressure causing it to adhere to the base) or by deposition by sputtering or the like.

Exemplary dimensions for the base 12 are about 0.015 inch for the width of the bottom 15, about 0.008 inch for width of the top 16 and a height of about 0.015 inch between such bottom and top. Overlay 13 has a thickness of only about 0.0004 inch, and its border portions 20 & 21 extend down over the sides 17 and 18 of the base by about 0.002 inch. The dimensions of the contact material 11 normal to its length are thus very small.

For the purposes of the present invention, the base 12 may be conveniently constituted essentially wholly of nickel. Alternatively, however, base 12 may be constituted essentially wholly of copper or of an alloy primarily constituted by weight of nickel (i.e., constituted 50% or more by weight of nickel), or of an alloy primarily constituted by weight of copper (i.e., constituted 50% or more by weight of copper). Also for the purposes of the invention, overlay 13 is constituted of a noble metallic material which conveniently may be essentially wholly gold. The noble metallic material of overlay 13 may, however, be any material selected form the group of materials consisting of gold, ruthenium, rhodium, platinum, iridium, osmium and alloys primarily constituted by weight of one or more of such metals (i.e., constituted 50% or more by weight of one or more of such metals). Silver and palladium are not included in this group because they are not sufficiently resistant to oxidation.

As indicated in FIG. 1 by the similarity of the stippling representing the respective visual appearances of base 12 and overlay 13, the metallic surfaces of the base and the overlay are highly glossy and are otherwise much like each other in visual appearance. Moreover, as stated, the dimensions of the contact material normal to its length are very small. Thus, without treatment according to the invention, it is extremely difficult or impossible to visually distinguish between the two surfaces. Nevertheless, it is important to have the capability of making such visual distinction for purposes of inspecting samples taken from rolls of the electrical contact material 11 to the end of determining whether or not the overlay 13 is properly placed in relation to the base 12.

Figure 3:
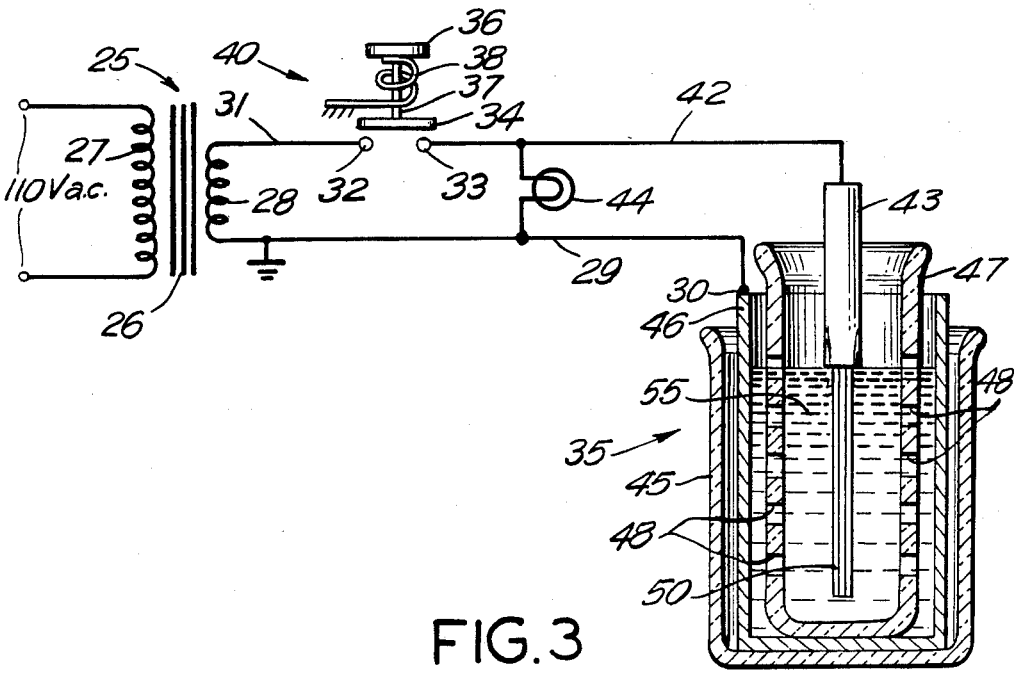
FIG. 3 is a schematic diagram of apparatus for treating a sample of such material according to the invention.

Attention is now directed to the apparatus shown in FIG. 3 for treating samples of the electric contact material to the end of enhancing the visual contrast between the base 12 and the overlay 13 (to thereby facilitate the determination by visual inspection of the placing of the overlay on the base). Such apparatus comprises a voltage step-down transformer 25 having a magnetic core 26 and input and output windings 27, and 28. Transformer 25 is adapted to convert 110 r.m.s. volts AC applied to its input winding 27 into a lower AC voltage appearing across its output winding 28. For the purposes of the invention, such lower voltage may have a value anywhere in the range from about 3.0 r.m.s. AC volts to about 10.00 r.m.s. AC volts.

One side of output winding 28 is connected by lead 29 to a first terminal 30 for an electrolyte cell 35. The other side of winding 28 is connected by lead 31 to one fixed contact 32 of a pair of spaced fixed contacts 32, 33 of a manually operable switch 40 further comprising: a moveable contact 34 adapted to bridge contacts 32, 33 when in engagement therewith, a manually actuated button 36, a stem 37 connecting the button to the moveable contact, guide means (not shown) for restricting movement of the assembly 34, 36, 37 to be along the axis of stem 37, and a compression spring 38 anchored at one end to a fixed point and pressing its other end against contacting button 36. Spring 38 normally biases assembly 34, 36, 37 away from fixed contacts 32, 33 so that moveable contact 34 does not bridge these fixed contacts and switch 40 is open. Such assembly is adapted however by pressure of a finger on button 36 to be moved against the bias of spring 38 until contact 34 bridges contacts 32, 33 to close switch 40.

Contact 33 is connected by a lead 42 to a second terminal 43 for the electrolytic cell 35. Connected between leads 43 and 29 is an incandescent bulb 44 which lights up when switch 40 is closed to thereby indicate that a.c. voltage is being applied across the cell terminals 30 and 43.

The electrolytic cell 35 comprises: an outer protective plastic beaker 45, a nickel crucible 46 disposed in beaker 45 and in ohmic contact with terminal 30 to provide a first electrode for the cell, and an inner protective plastic beaker 47 disposed within the crucible electrode 46 and having perforations 48 in the cylindrical bounding wall of the beaker. To provide the second electrode for the cell, the terminal 43 is in the form of an alligator clip, and such clip is shown in FIG. 3 as grasping the sample 50 (of electric contact material 11) which is illustrated in more detail in FIG. 4. Sample 50 has a length of about two inches, and clip 43 is held either by hand or by a support (not shown) so that sample 50 extends down into the interior of cell 35 to act as a second electrode therefor. Beaker 47 prevents inadvertent contact between the sample 50 and the crucible electrode 46 when the clip 43 is held by hand. In both FIG. 3 and FIG. 4, the showing of sample 50 is not to scale in that its dimensions normal to its length are shown on a much larger scale than is its length.

The crucible 46 of cell 35 contains a body of electrolyte 55 which passes through the perforations 48 in beaker 47 to fill the interior thereof to a height at which most of the length of sample 50 is immersed in the electrolyte. The electrolyte 55 is an aqueous solution of a readily soluable ionizable solute which may either be nitric acid or an alkali metal or alkaline earth metal salt of a suitable strongly reactively inorganic acid. Examples of such suitable acids are nitric, sulfuric, hydrochloric and hydrobromic acid. Examples of suitable alkali metal salts are salts of sodium and potassium, and examples of suitable alkaline earth metal salts are readily soluable salts of calcium and magnesium. Alternatively, such solute may be constituted of a mixture of two or more of such acids, a non-precipitating mixture of two or more of such salts, or a non-precipitating mixture of one or more of such salts and one or more of such acids. Desirably, when the solute is a metal salt or a non-precipitating mixture of two or more metal salts, the solute constitutes a percentage by weight of the electrolyte 55 in the range from about 10% to about 20%. Whatever, however, the value used for the percentage by weight of the solute in the electrolyte, the solute desirably is fully dissolvable in the aqueous solvent.

Figure 4:
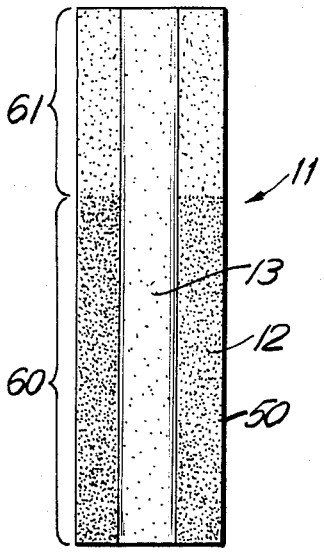
FIG. 4 is a plan view of such sample after it has been so treated.

The use of the FIG. 3 apparatus with a sample 50 is as follows. As a preliminary, a piece of a roll of electric contact material 11 in tape form is severed from such roll to provide the sample. That sample 50 is then gripped at one end by clip 43 which is thereupon positioned to immerse most of the sample below the clip in the electrolyte 55. The switch 40 is next closed to apply a.c. voltage across the spaced electrodes 46 and 50 of cell 35, both such electrodes being then in contact with electrolyte 55. In response to the application of the voltage, a.c. current flows through the electrolyte between the two electrodes to produce evolution of gases at both of them. With continuing application of such voltage and flow of such current, the metallic surface of the base 12 of sample 50 will sustain a progressively increasing darkening or blackening while the metallic surface of the overlay 13 of the sample will remain substantially unaffected. Such darkening or blackening is represented in FIG. 4 wherein the lower portion 60 of base 12 which has been immersed in electrolyte 55 and exposed to the described current is shown as being much darker than the upper portion 61 of such base which remained above the electrolyte.

When such darkening or blackening has enhanced the visual contrast between the surfaces of base 12 and overlay 13 to the point where the two surfaces can readily be visually distinguished from each other, the application of a.c. voltage to cell 35 and the resulting flow of current through electrolyte 55 is terminated by removing finger pressure from switch 40 to cause it to open. Thereafter, sample 50 is removed from cell 35 and visually inspected with the aid of a low power microscope or otherwise to determine the placing of the overlay 13 on base 12. If the overlay is properly located in relation to the base, the roll from which sample 50 was severed will be accepted. If, however, the overlay is substantially off-center from base 12 or otherwise violates the specifications for the overlay, such roll will be rejected.

In order to produce a suitable darkening or blackening of the immersed portion 60, the sample 50 should be exposed to the a.c. current through the electrolyte for a time period which preferably lasts for at least 3 seconds.

That time period has no critical upper limit but 30 seconds is usually more than adequate.

In order to produce appropriate darkening or blackening of the immersed portion of base 12 of sample 50 by the described treatment, the steps described above need not necessarily be performed in the order described above. As one example, adequate darkening or blackening can also be produced by first closing switch 40, then immersing sample 50 in the electrolyte 55 for a time period long enough for suitable darkening or blackening to take place, then removing sample 50 from the electrolyte and finally opening switch 40.

Further details on methods according to the invention are given in the section which follows.

DETAILS OF METHODS

The methods of this invention makes use of the fact that noble metals and alloys thereof are extremely resistant to most chemicals (hence the term noble) and the reactions that occur with most other metals. Nickel is a metal that is oxidization resistant and imparts that quality in varying degrees also to its alloys with other metals making them slow to react with most chemicals. The same is true of copper and its alloys. Therefore, an extra driving action is required to produce sufficient reaction in a few seconds time for this invention to be usable as an inspection tool. By making the sample of contact material one electrode in an electrolyte solution of chemicals intended to react with the base of nickel, copper or respective alloys thereof, a voltage can be impressed on the subject sample and thus add the driving action to speed the reaction, or in some cases force a reaction which might not proceed otherwise.

A number of electrolytes, e.g., various common salts, most acids, etc., were found to react vigorously with the contact base with the application of current but only a few react in a manner to produce a high color contrast between the reacting base material and the non-reacting noble metallic material. One strong, oxidizing acid, namely, nitric acid, was found to react in the desirable manner of causing the base to turn black. This same acid reacts slowly with the base without the application of current but the contrast between the noble metallic material and the base metal is very slight. With current applied the contrast is very high and the reaction rate is greatly increased.

The desired reaction on the base metallic materials could not be produced with the application of direct current with either polarity. With the sample as the anode (positive) the base was found to become etched as some of the base metallic material went into solution. However, the contrast between the base metallic material and the noble metallic material is low. With the polarity reversed, no enhancement of contrast was produced between a nickel/copper base and a noble metal overlay.

By using alternating current a high color contrast is produced between the noble metallic material and base as previously described. It was found that the A.C. voltage can be between 3 VAC and 10 VAC. Below this range the reaction rate is too slow for practicability and above this range the reaction is so vigorous that the black deposit on the base material is so loosely adhering that the contact strip cannot be wiped dry without loss of the particulate black deposit that is formed on the base.

When the solute is a readily soluable ionizable metal salt or a non-precipitating mixture of one or more of such salts, the concentration of ionizable solute in solution is not critical but has a lower limit below which the reaction is too slow to be a feasible method for identifying metals bonded for contact use as described above. It has been determined that a solution containing at least 10% by weight of such solute in water is required. If more than twice this value is used the reaction becomes too vigorous and results in poor adherance of the dark deposit similar to when the voltage is too great.

EXAMPLE 1

The reaction salts of an alkali metal (e.g., sodium) and a halogen acid, except iodic acid, in water gives a reaction at 6 VAC with nickel and nickel alloys which result in a deep black coloration in about 5–10 seconds. A noble metal overlay of gold fails to react so the contrast between it and the blackened base allows the location of the noble metal to be easily ascertained. If the base alloy is copper or a copper alloy the same electrolyte and voltage conditions cause a darkening of the base material that is more deep gray than black but still readily separates it in appearance from a noble metal overlay.

EXAMPLE 2

One common acid, $HNO_3$, at a concentration of 3% $HNO_3$ in water was found to function well at 3 to 10 VAC to blacken nickel and copper alloys to make them easily identified from noble metal overlays. The alkali metal salts of this acid work equally well in water solution when at the above described conditions of voltage and salt concentration.

EXAMPLE 3

Alkali metal salts of sulfuric acid work well in water solution at the prescribed salt concentration and voltage, turning the base of nickel or copper or respective alloys thereof deep gray to black, depending on the alloy, while the noble metal overlay remains unchanged.

An explanation of the described darkening or blackening of the base material in response to its described exposure to a.c. current through the described electrolyte is that the passage of such current produces disassociation of the water of the electrolyte into hydrogen and oxygen at both electrodes, and that, since the evolved oxygen is monatomic, it readily oxidizes the metallic material of the base to produce its observed darkening or blackening. As another phenomenon which may be involved, the a.c. current may produce alternate deplating and replating of the nickel or copper in the base material so that nickel or copper metal is first separated from the base and then deposited back thereon in the form of very small black or gray particles constituted of an oxide of such metal and adhering firmly to the base. The invention hereof is not, however, to be considered as dependent on the correctness of such explanation.

The above described article, apparatus and methods being exemplary only, it will be appreciated that the invention is not restricted thereto, and that additions to, omissions from, and modifications of, such article, apparatus and methods can be made without departing from the spirit of the invention. Accordingly, the invention is not to be considered as limited save as is consonant with the recitals of the following claims.

What is claimed is:

1. A method of enhancing the visible contrast in electrical contact material of parts thereof which respectively are, first, a substrate consisting of nickel, copper or an alloy primarily constituted by weight of nickel or copper and, second, an overlay bonded to and covering part of said substrate and provided by a noble metallic material selected from the group consisting of the noble metals gold, ruthenium, rhodium, platinum, iridium, osmium and alloys primarily constituted by weight of one or more of such metals, said method comprising, providing an aqueous solution of a readily soluable ionizable solute, applying an alternating voltage of a value in the range from about 3 r.m.s. volts a.c. to about 10 r.m.s. volts a.c. to a circuit comprising said electrolyte, a first electrode constituted of said substrate and overlay, and a second electrode in contact with said electrolyte and spaced from said first electrode, and exposing said substrate and overlay to current produced in said electrolyte by application of said voltage for a time period sufficient to produce noticeable visible darkening of the surface of said substrate relative to the surface of said overlay.

2. A method according to claim 1 in which said ionazable solute is a strongly reactive inorganic acid or a readily soluable, alkali metal or alkaline earth metal salt thereof; a mixture of two or more of such acids; a non-precipitating mixture of two or more of such salts; or a non-precipitating mixture of one or more of such acids and one or more of such salts.

3. A method according to claim 2 in which, when said solute is constituted of an alkali metal salt or alkaline earth metal salt of such an acid or a non-precipitating mixture of two or more of such salts, such solute is present in said electrolyte in a percentage by weight of such electrolyte in the range from about 10% to about 20%.

4. A method according to claim 1 in which said substrate and overlay are exposed to said current through said electrolyte for a period of at least three seconds.

5. A method according to claim 1 in which said darkening of said surface of said substrate is produced by the formation on such surface of a coating of dark particles adhering firmly to such surface.

6. A method according to claim 1 in which said electric contact material is in the form of a length of tape in which said substrate and said overlay form a base and a strip, respectively, for said length of tape, said base being of isoceles trapezoidal cross-section normal to its length, and said strip having a central portion overlying the top of said base portion and, also, border portions which are on opposite sides of said central portions, and which extend down therefrom to cover part of each of the opposite sides of said base, said strip having a thickness which is a small fraction of the height of said base between its top and its bottom.

* * * * *